US010974252B2

(12) United States Patent
Janetta et al.

(10) Patent No.: US 10,974,252 B2
(45) Date of Patent: Apr. 13, 2021

(54) COMMINUTION DEVICE FOR LABORATORY OPERATION, AND DAMPER FOR A COMMINUTION DEVICE

(71) Applicant: Retsch GmbH, Haan (DE)

(72) Inventors: Frank Janetta, Bottrop (DE); Ralf Eisenbach, Wuppertal (DE); Alexander Hoehne, Haan (DE)

(73) Assignee: RETSCH GMBH, Haan (DE)

( * ) Notice: Subject to any disclaimer, the term of this patent is extended or adjusted under 35 U.S.C. 154(b) by 257 days.

(21) Appl. No.: 16/087,283

(22) PCT Filed: Mar. 24, 2017

(86) PCT No.: PCT/EP2017/025058

§ 371 (c)(1),
(2) Date: Jan. 15, 2019

(87) PCT Pub. No.: WO2017/162340

PCT Pub. Date: Sep. 28, 2017

(65) Prior Publication Data

US 2019/0160472 A1 May 30, 2019

(30) Foreign Application Priority Data

Mar. 24, 2016 (DE) ..... 102016003493.9
Nov. 2, 2016 (DE) ..... 102016013022.9

(51) Int. Cl.
*B02C 18/00* (2006.01)
*B02C 18/22* (2006.01)
(Continued)

(52) U.S. Cl.
CPC ..... *B02C 18/2291* (2013.01); *B02C 18/062* (2013.01); *B02C 23/00* (2013.01); *B02C 23/02* (2013.01)

(58) Field of Classification Search
CPC ... B02C 18/2291; B02C 18/062; B02C 23/02; B02C 23/00
(Continued)

(56) References Cited

U.S. PATENT DOCUMENTS 3,229,921 A * 1/1966 Hess ..... B02C 18/14 241/190
3,643,880 A * 2/1972 Peterson, Jr. ..... B02C 23/00 241/100
(Continued)

FOREIGN PATENT DOCUMENTS

DE 2650008 A1 5/1978
DE 3514919 A1 10/1986
(Continued)

OTHER PUBLICATIONS

International Search Report for PCT/EP2017/025058 dated Aug. 31, 2017, 8 pages.
(Continued)

*Primary Examiner* — Faye Francis
(74) *Attorney, Agent, or Firm* — FisherBroyles, LLP; Craig W. Mueller

(57) ABSTRACT

A comminution device for laboratory operation is described. More specifically, a laboratory mill, particularly a centrifugal mill, is provided that includes a milling tool arranged in a milling chamber, a housing assembly, and a milling material channel running through the housing assembly. The milling material channel opens into the milling chamber and is configured to supply, for supplying milling material to the milling chamber or to discharge milled material from the milling chamber. The milling material channel may be open to the environment and/or can be opened for successively supplying milling material to the milling chamber during the milling operation. At least one system for passively reducing
(Continued)

noise emissions is provided and situated in the region of the milling material channel.

11 Claims, 8 Drawing Sheets

(51) Int. Cl.
*B02C 23/02* (2006.01)
*B02C 18/06* (2006.01)
*B02C 23/00* (2006.01)

(58) Field of Classification Search
USPC ..... 181/198
See application file for complete search history.

(56) References Cited

U.S. PATENT DOCUMENTS 3,951,245 A * 4/1976 Hench, Sr. ..... B29B 9/06 193/32
4,061,282 A * 12/1977 Walker ..... B02C 18/144 241/222
4,371,120 A * 2/1983 Grapin ..... B02C 17/22 241/182
5,000,391 A * 3/1991 LaPointe ..... B02C 18/148 241/285.2
5,226,603 A * 7/1993 Reichner ..... B02C 13/08 241/275
5,662,282 A 9/1997 Meyer
2010/0243779 A1* 9/2010 Carver ..... B02C 18/0007 241/294
2019/0126285 A1* 5/2019 Janetta ..... B02C 18/062
2019/0133378 A1* 5/2019 Kim ..... A47J 43/046
2019/0160472 A1* 5/2019 Janetta ..... B02C 23/00
2020/0055057 A1* 2/2020 Stahl ..... B02C 18/186

FOREIGN PATENT DOCUMENTS

DE 10066027 5/2002
EP 0727254 B1 2/1996
JP S4887670 U 10/1973
JP 2003010714 A 1/2003
JP 2014113519 A 6/2014

OTHER PUBLICATIONS

Written Opinion for PCT/EP2017/025058 dated Aug. 31, 2017, 8 pages.

* cited by examiner

COMMINUTION DEVICE FOR LABORATORY OPERATION, AND DAMPER FOR A COMMINUTION DEVICE

This application is the National Phase of PCT Application No. PCT/EP2017/025058, filed Mar. 24, 2017, which claims the benefit of German Patent Application Serial Nos. 102016003493.9 and 102016013022.9, filed with the German Patent and Trade Mark Office on Mar. 24, 2016 and Nov. 2, 2016, respectively.

FIELD OF THE INVENTION

The invention relates to a comminution device for laboratory operation, particularly a laboratory mill, especially particularly a centrifugal mill, with a milling tool arranged in a milling chamber, with a housing assembly and with a milling material channel running through the housing assembly into the milling chamber for supplying milling material to the milling chamber and/or discharging milling material from the milling chamber, in particular wherein the milling material channel during milling operation is open to the environment and/or can be opened, especially particularly for successively supplying a milling material to the milling chamber during the milling operation. Moreover, the present invention relates to a damper as a separate component for use in a comminution device of the aforementioned type.

BACKGROUND OF THE INVENTION

Comminution systems develop periodic sound emissions due to the comminution processes that take place during the milling process. These signals, coupled to the rotational speed of the comminution system, are very disturbing due to the usually high speeds in laboratories.

With centrifugal mills, this leads to strong impacts during the milling process due to high centrifugal forces acting on the parts being crushed by a fast-rotating milling tool. As a result, the equipment parts of the mill surrounding the milling chamber are excited to vibrate so that air and vibration noise emissions emanate from the milling chamber. The total sound energy radiated from the comminution device is about 30% discharged over the surfaces of the housing to the environment, while about 70% is emitted as sound via the feed and discharge openings of the comminution device.

Sound emissions are based on vibrations of the ambient air, which reach the environment through a milling material channel through which the milling material is supplied to and/or removed from the milling chamber from the comminution device and as such can directly reach the human ear. If the milling material channel is open during the milling operation for successively supplying the milling material to the milling chamber, there is a continuous sound path between the emission source in the area of the milling tool and the environment of the comminution device. Furthermore, vibration emissions occur based on shocks and vibrations of equipment parts of the comminution device directly or indirectly surrounding the milling chamber. These equipment parts can cause ambient air to vibrate and thus amplify sound emissions from the milling material channel. In addition, the vibrating machine parts in turn cause adjacent equipment parts to vibrate, with the result that the adjacent equipment parts also create noise.

To reduce sound emissions it is already known from the prior art to equip the housing parts of comminution devices with sound-absorbing materials. However, a complete encapsulation of the comminution device by a soundproof enclosure is not possible if the milling material channel must be open to supply or remove milling material during the milling operation.

SUMMARY OF THE INVENTION

The object of the present invention is to provide a comminution device of the type mentioned that has a greatly reduced sound radiation in the comminution and milling operation. The invention in particular is based on the object of reducing sound emissions that emerge as noise through the milling material channel or are transmitted through the housing and/or device parts of the comminution device forming the milling material channel and/or adjoining them in a simple and inexpensive manner in terms of equipment, wherein, preferably, supplying a milling material to the milling chamber and if necessary removing a milling material from the milling chamber are possible during the milling operation.

The invention solves this task with a comminution device of the type mentioned above, such that in the area of the milling material channel at least one system is present for passive reduction of sound emissions. The invention is based on the principle of damping noise development transmitted in particular as sound through the milling material channel during operation of the comminution device. Moreover, the invention preferably also addresses the reduction of vibration emissions that emanate from the housing and/or device parts surrounding the milling material channel. Through the system according to the invention, compared with a comminution device otherwise designed identically that does not have such a device a noise reduction of preferably at least 10 dB(A), more preferably at least 20 dB(A), particularly preferably more than 30 dB(A) or greater is achieved.

The above object is also achieved by a damper as a separate device part for use in a comminution device for laboratory operation, the damper being designed as a muffler for reducing sound emissions in particular.

A system according to the invention for reducing sound emissions can be a separate damper connected with the comminution device if needed. Alternatively or additionally, however, the housing and/or device parts of the comminution device forming the milling material channel and/or adjoining it can also be created by a particular housing and/or device geometry for passive reduction of sound emissions. The invention particularly addresses the problem of sound emissions through the milling material channel that can be open for supplying or removing milling material during the milling operation. In particular, the system according to the invention for passive reduction of sound emissions should allow an unhampered supply or removal of milling material during the milling operation and not close the milling material channel to the environment.

The measures proposed and described below according to the invention for passive reduction of noise emissions in the area of the milling material channel can be combined with measures known inherently from the prior art for sound insulation of the housing of the comminution device, so that an even greater reduction of noise emissions is achievable.

In particular, the comminution device according to the invention can be, for example, a centrifugal mill designed as rotor mill with a rotor that can be coupled to a drive motor as milling tool. The comminution device can also be designed as a jaw crusher, cutting mill, vibration disc mill, ball mill or knife mill.

The milling material channel passes through at least one housing part of the housing assembly and/or at least one separate component connected with the housing assembly. For example, a milling material hopper of the comminution device can be formed by a housing wall of the device lid that surrounds the milling material channel. A tubular material inlet can be connected with the housing lid, with the housing lid itself forming a milling material hopper and the milling material channel extending through the material inlet and the milling material hopper to the milling chamber. This is shown and described, for example, in EP 0 727 254 A1.

To simplify feeding of the milling material, the free cross-section of the milling material channel can taper funnel-shaped to the milling chamber so that the milling material feed to the milling chamber can occur successively in small amounts, especially through a feed system such as a vibrating chute or the like.

The milling material channel can also be formed and/or bounded by a separate component with, in particular, a funnel-shaped inner contour, connected, for example, with a housing part of the comminution device. For example, it is described in DE 100 66 027 A1 that a separate component forming the milling material channel is firmly screwed to a housing lid of the comminution device.

What is more, a funnel-shaped inlay can be inserted into the milling material channel to simplify the material feed to the milling chamber and enable easy cleaning by replacement of the inlay.

In a preferred embodiment of the invention, a separate damper is used for passive reduction of sound emission in the milling material channel. The damper forms a hollow body, causing partial reflection of sound waves through a suitable cross-section geometry of the inside of the damper. Passage through the muffler can cause an averaging of the sound pressure amplitude, resulting in a reduction of sound pressure peaks. Reflections can be created in the muffler by baffles and cross-sectional expansions and narrowings. The operating principle is based on partial reflection of sound waves from cross-sectional and directional changes, and optionally the generation of higher modes of jumps in the flow guidance in the damper. If a jump-like change in the free cross-section occurs due to the flow guidance through the damper, reflections and higher modes can occur at this jump level causing additional damping. In principle, the damper can also be designed as a resonance silencer. An air flow is induced in conjunction with an acoustic mass for the resonance. Energy is withdrawn from the sound field in the area of the resonance frequency. Counter-waves can be generated by the arrangement of differs ent baffle plates, with the goal of cancelling the sound waves to be damped.

A separate damper can be inserted into a milling material hopper of the comminution device in the area of the milling material channel. The damper can be detachably connected nondestructively with the milling material hopper. An embodiment is also possible and advantageous in which the damper above a milling material hopper is set on a housing of the comminution device and separably attached to the housing. The damper can thus be removed as needed; for example, for a cleaning or replacement. To further reduce the creation of sound emissions during milling operation, it is advisable to largely exclude relative movements between the damper and the housing and/or device parts of the comminution device forming the milling material channel and/or adjoining it through the type of connection of the damper with the comminution device.

In an alternative embodiment of the invention, the walls of the housing surrounding, forming or bounding the milling material channel, or separate components connected with the housing and at least partly forming the milling material channel, can have a damper geometry and as such create a damper integrated into the device architecture for passive reduction of noise emissions by at least partial reflection of sound to cross-sectional and/or directional changes in the damper. For example, a milling material hopper of the comminution device can be designed as integrated damper and have a structural design that contributes to a passive reduction of sound emissions. In the alternative embodiment described, no separate damper is inserted into the milling material channel; instead, the inner contour of the housing and/or device parts of the comminution device forming and/or bounding it is structurally designed such that the milling material channel as such is characterized by cross-sectional and/or directional changes that can lead to a damping by partial reflection of sound waves.

The following statements apply to both an embodiment of the invention with a separate damper and an embodiment of the invention with a damper integrated into the device architecture.

The supply or removal of the milling material to and from the milling chamber preferably occurs through the damper, where an air exchange between the milling chamber and the environment of the comminution device is possible. A simple milling material sups ply and/or removal can be assured through a suitable structural design of the damper.

The damper can be closed on the shell side, so that no sound can escape from the damper on the side into the environment.

If the damper is formed as a separate component, in the condition when in use the damper with its outer shell surfaces can lie directly against a housing wall surrounding the milling material channel and/or an adjacent part forming the milling material channel so that air passage between the damper and the adjacent wall is impeded. For example, the damper can be inserted into a milling material hopper of the comminution device and when in use then lies with its outer shell surfaces directly against the milling material hopper.

For a milling material inlet or outlet to and from the milling chamber through the damper, on the front side on its proximal end facing the milling chamber and its distal end facing away from the milling chamber the damper can have an opening, where preferably two central openings are provided on opposite ends of the damper and arranged coaxially. The opening at the proximal end of the damper may have a larger cross-section than the opening at the distal end of the damper. The opening at the proximal end of the damper has a flow exchange with the milling chamber and the opening at the distal end has a flow exchange with the environment. With the exception of the two openings the damper can preferably be formed fully closed. The smaller opening at the distal end of the damper contributes to the least possible sound emission into the environment.

To cover the input opening of the damper as needed and thus close the milling material channel if no supply or removal of milling material is necessary, a preferably insulated lid is provided.

Particularly preferred is a decentralized or eccentric supply of the milling material to the damper. For this purpose the milling material can be supplied through a feed trough that on the side gives the milling material a funnel geometry formed by the damper. The funnel geometry then causes the milling material to slide farther down in the direction of the milling chamber. The feed chute can be guided through a cover of the damper so that sound then escapes only through the feed chute. Through a rotatable arrangement of the cover of the damper, it can be possible to turn the outer opening of the feed chute to a side facing away from the user and thus direct the exit of sound emissions to this side.

Apart from that, with the damper an eccentric feed of the milling material to a milling material hopper of the comminution device can also be possible. For this purpose the damper can have a hopper part, the outlet opening of which is arranged above the milling material hopper. The outlet opening of the hopper part can be arranged eccentric to the milling material hopper so that the milling material is supplied through the hopper part to the inclined inlet surfaces of the milling material hopper and not in the center to the milling material hopper. Through a rotatable arrangement of the hopper part, it is possible to change the position of the outlet opening of the hopper part relative to the milling material hopper and thus the location of the milling material supplied to the milling material hopper in the circumferential direction of the inclined inlet surfaces of the milling material hopper.

Starting from its proximal end the damper can have at least one constant, i.e. continuous or discrete, i.e. discontinuous cross-sectional change in the distal direction. The cross-sectional change produces reflections of the sound waves with the damping effect described above. In particular, the damper in the distal direction has at least one constant or discrete cross-sectional expansion. For example, the damper cross-section from the proximal end of the damper in the distal direction through a first, proximal damper portion can be constant and in a subsequent, second distal damper portion can steadily increase. The first, proximal damper portion then has a cylindrically shaped inner surface and a second, distal damper portion has a conical or truncated cone-shaped inner surface. In the transition area of two portions with different cross sections, the cross-sectional change can be formed constant or also discontinuous or discrete in the form of a gradation. Alternatively, it is possible that the first, proximal damper portion has a conical inner surface, where the damper cross-section in the distal direction can steadily increase or decrease through the first, proximal damper portion. The second, distal damper portion may also have a conical inner surface with a damper cross-section steadily increasing in the distal direction or the second damper portion can have a cylindrical inner surface. The cross-section increase can be linear through a portion of the damper in the distal direction or also increase in the distal direction of the damper so that the damper's inner surface preferably is curved outward.

Preferably, the damper at its distal end directed outward or to the environment when in use has a curved inner surface or deflector plate that inside the damper causes a sound reflection and, preferably, a directional deflection in the radial direction to the central longitudinal axis of the damper and/or in the proximal direction to the milling chamber. The reflection and directional deflection results in the damping effect described above.

Apart from that, the damper can form a funnel geometry as material inlet for the milling material, where distal wall surfaces of the damper on the damper inside can cause sound reflection, change of direction and deflection of sound waves back into the inside of the damper. Where the interior is passed through multiple times, this can greatly reduce sound pressure peaks. The funnel geometry at the distal end of the damper can have a central funnel neck formed coaxial to the central longitudinal axis of the damper and extending proximally into the interior of the damper relative to the distal end of the damper. The funnel neck is formed by a central opening at the head end of the damper. At the distal end of the damper, dead spaces or baffle spaces are created in which the sound waves are reflected and can be guided back in the direction of the milling chamber. It can be expedient if the damper at its head end is closed with the exception of a central opening and, preferably, has the contour of a semicircular torus in the longitudinal section.

The damper can have a proximal shell portion extending from the proximal end in the distal direction and possibly at least one further, distal shell portion distally subsequent to the proximal shell portion. A head portion can be provided at the distal end of the damper. Each shell portion can have one at least partially cylindrical and/or conical shell inner surface. With the exception of a central opening, the head portion can have a closed inner surface that is bent or angled relative to the shell surface in the radial direction to the central longitudinal axis. In the area of the central opening, the inner surface can then be bent, curved or angled inward in the proximal direction, also conical. At its distal end the damper can correspondingly form a funnel geometry. There is then a change of direction and deflection of sound waves inside the damper at the hopper surfaces back into the interior of the damper.

The damper can also be designed as a combined reflection and absorption muffler. For this purpose, the damper can have an at least partial liner and/or arrangement with a sound-absorbing material. The sound-absorbing material can preferably be provided inside at the distal end of the damper, where there is a change of direction and deflection of sound waves back into the interior of the damper. If at its distal end in the longitudinal section the damper has the contour of the semicircular torus, the sound-absorbing material can lie on the inside against the damper in the area between an outer wall of the damper and a funnel neck formed in the axial, middle area of the damper that extends proximally into the damper interior relative to the distal end of the damper.

At least in areas, the damper can be formed double-walled. An air layer between two adjacent walls of the damper can contribute to reducing sound emissions. The area between two adjacent walls of the damper can also be filled with a solid insulating material that contributes to reducing sound emissions.

In the connection area of a separate damper with the comminution device, a sealing means can be provided to prevent relative movements during the milling operation between the damper and housing and/or device parts of the comminution device and therefore creation of new sound emissions and/or an air passage, and thus the transmission of sound between damper walls and adjacent housing and/or device walls.

The cross-section geometry of a separate damper at least at the proximal end of the damper can be adapted to the cross-section geometry of a milling material hopper of the comminution device. With a funnel-shaped milling material inlet or outlet, the damper at its end can also be formed correspondingly funnel-shaped so the damper can be easily and if necessary positively and/or non-positively inserted into the milling material hopper, and the most full-area arrangement of the damper against the milling material hopper possible achieved.

The housing and/or device parts of the comminution device forming and/or bordering the milling material channel can likewise have an insulation with a sound-absorbing material for passive reduction of sound emissions. Housing and/or device parts that form the milling material inlet and/or the milling material outlet can be formed sound-absorbing. A sound-absorbing material can be, for example, insulation made of rock wool, mineral wool, glass wool, glass fibers or foams. To receive the sound-absorbing material, a double-wall design of the housing and/or device parts of the comminution device forming and/or bordering the milling material channel can be provided. An encapsulation of the insulating material is then possible so that a contamination by the milling material is excluded.

The damper may be of metal, especially stainless steel, but also from polyurethane, polyethylene or a hard silicone material, or comprise the aforementioned materials. Particularly preferably, however, the parts of the damper that come into contact with the milling material are of stainless steel. In particular, with a separate damper this can possibly also consist of a soft insulating material or the like. Such a material offers a high inner insulation especially against high frequencies and ones thus experienced as particularly unpleasant. This may be a non-elastic, almost gel-like material that opposes hardly any restoring force to an active force. Such a material is characterized by a high impact strength. A soft polyurethane, a thermoplastic polyethylene, or a hard silicone material enter into consideration, for example. It should be possible to process by means of injection molding methods to enable inexpensive production of the damper. If the damper is designed as disposable or single-use, the need for cleaning the damper when the filling material is changed is eliminated. To reduce the soiling tendency of the damper on its inside, the inner surface of the damper can have a low roughness and a low wettability, as observed with the lotus plant (the lotus effect). Through self-cleaning abilities of the inner surfaces of the damper the soiling tendency can be greatly reduced, thus increasing the damper's useful life until a renovation, cleaning or replacement of the damper is required.

The damper can preferably be formed as several parts and/or capable of being taken apart. This creates the possibility of easy cleaning of the damper. Several parts of the damper may be joined together by being twisted or plugged to each other. With an integrated damper, access to its interior in particular can occur by partial dismantling of the housing assembly. With a separate damper, it can be easily taken out of the milling material channel and then disassembled and cleaned.

It is understood that the features of the invention's embodiments described above can be combined with each other as needed, even if this is not expressly described in detail. The paragraph formatting chosen does not exclude a combination of the invention features described in individual paragraphs.

In the following, preferred embodiments of the invention will be explained in more detail with reference to schematic drawings. For functionally similar features the same reference numbers are used.

DETAILED DESCRIPTION

Figure 1:
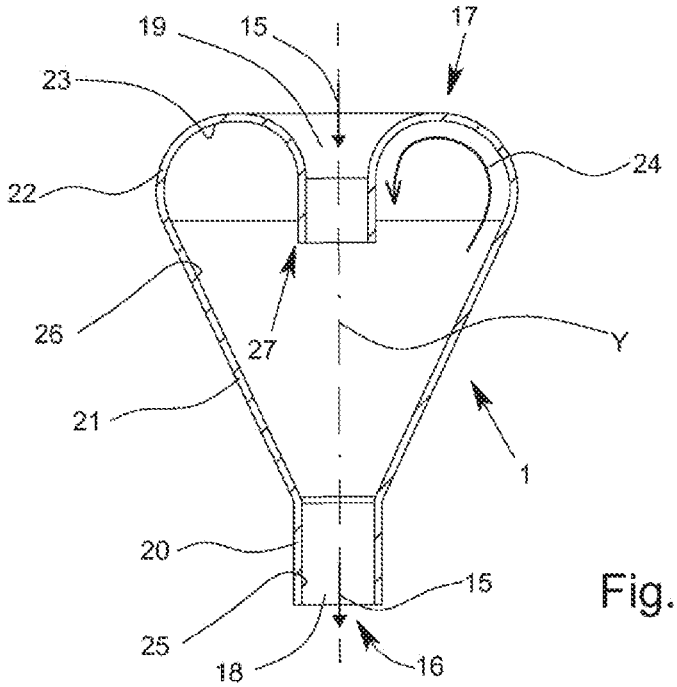
FIG. 1 is a longitudinal section view of a first embodiment of a damper designed and provided as a separate device part for use in a comminution device for laboratory operation.
Figure 3:
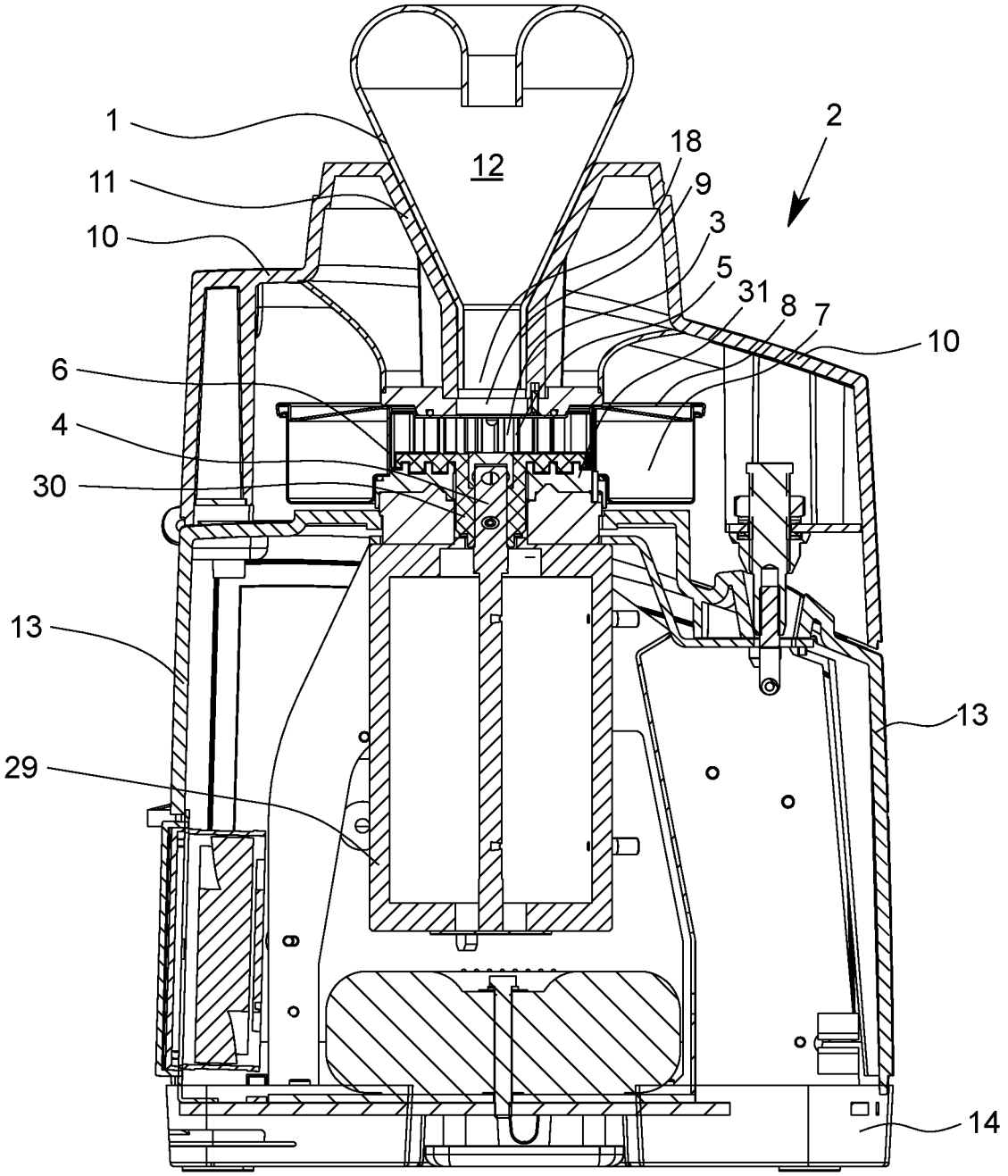
Figure 4:
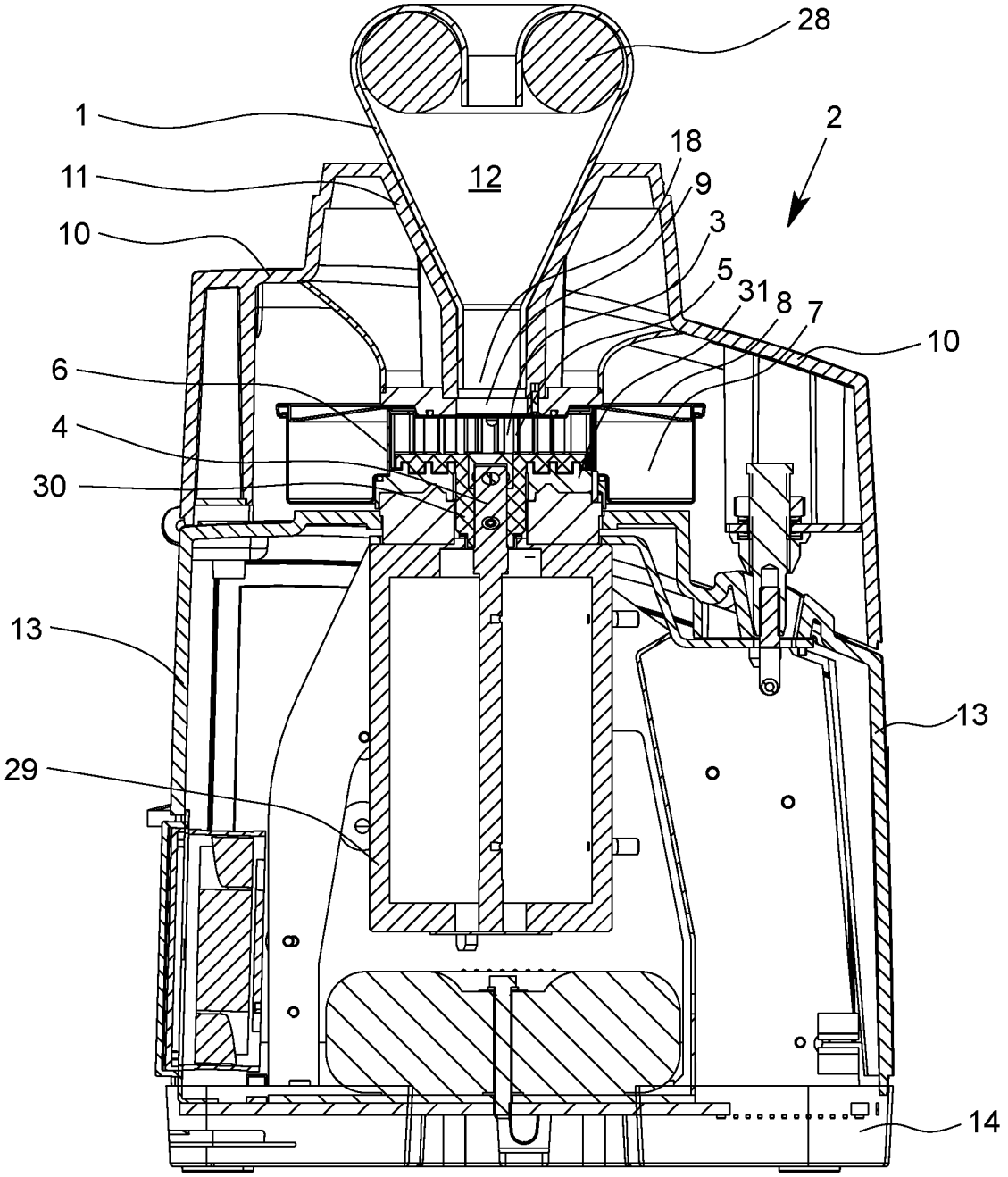

FIG. 1 shows a muffler 1 as a separate device part for use in a comminution device 2 for laboratory operation, for example as shown in FIGS. 3 and 4. The comminution device 2 is, for example, a centrifugal mill as shown. The basic structure of the comminution device 2 can correspond to the basic structure of the centrifugal mill described in EP 0 727 254 A1. The damper 1 is designed for passive reduction of noise emissions emanating from a milling chamber 3.

As shown in FIGS. 3 and 4, the comminution device 2 has a rotor 5 coupled to a drive shaft 4 as milling tool, where the milling chamber 3 of rotor 5 is surrounded by an annular sieve 6 and on the outer circumference of the annular sieve 6 an annular collection container 7 is arranged for the crushed milling material. The collection container 7 is covered with a container lid 8. The milling unit consisting of rotor 5, annular sieve 6 and collection container 7 can be closed with a housing lid 10 having a milling material inlet opening 9.

The milling material feed into the milling chamber 3 occurs through a milling material hopper 11, which is formed by a wall of the housing lid 10 and forms or borders a milling material channel 12 of the comminution device 2. The milling material channel 12 is connected with the milling material inlet opening 9 and therefore with the milling chamber 3. The milling material channel 12 is open to the environment during the milling operation. This enables a successive feed of the milling material to the milling chamber 3 during the milling operation.

To house the comminution device 2 at least one housing 13 is additionally provided, which can also be designed in multiple parts. The closure downward is formed by a base plate 14.

Figure 2:
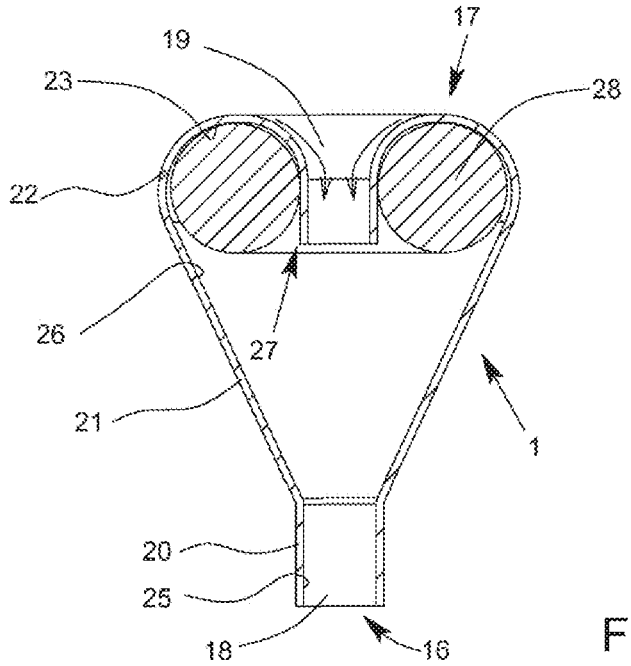
FIG. 2 shows the damper of FIG. 1 with the arrangement of a sound-absorbing material inside the damper, FIG. 3 inserts the damper of FIG. 1 into a milling material channel of a centrifugal mill, FIG. 4 inserts the damper shown in FIG. 2 into the milling material channel of the centrifugal mill shown in FIG. 3.

For passive reduction of noise emissions, the muffler 1 shown in FIG. 1 and FIG. 2 can be inserted into the milling material hopper, preferably detachably. This is shown in FIG. 3 for damper 1 from FIG. 1 and in FIG. 4 for damper 1 from FIG. 2. Damper 1 is des signed for passive reduction of noise emissions by reflection of sound from cross-sectional and/or directional changes in damper 1. For this, damper 1 is brought into the sound path between milling chamber 3 and the external air surrounding comminution device 2. Barriers are placed in the way of the sound waves in damper 1 so that they are thrown back and diverted. The sound waves partially cancel each other out. Various cross-sections of damper 1 lead to sound reflection and therefore sound reduction. The reduction of noise emissions through damper 1 attributable to damper 1 is at least 10 dB(A), preferably at least 20 dB(A), particularly preferably at least 30 dB(A) relative to a non-damped operation of comminution device 2.

As emerges in particular from FIGS. 1 and 2, the milling material is supplied to milling chamber 3 through damper 1. The milling material channel 12 correspondingly runs through damper 1 and is bordered on the outside by damper 1. The transport of material through damper 1 is shown schematically by arrows 15 in FIG. 1.

The damper 1 is closed on the shell side and the front side at its lower, proximal end 16 and at its upper, distal end 17 each has a central opening 18, 19. The outlet opening 18 and inlet opening 19 are arranged coaxially in the embodiment shown. The outlet opening 18 preferably has a larger cross-section than the inlet opening 19.

Damper 1 can have a wall designed as one part or multiple parts with a proximal shell or damper portion 20, a distal shell or damper portion 21 subsequent to it distally, and a distal head portion 22. For an effective sound reduction the clear damper cross-section going from the proximal end 16 of damper 1 in the distal direction can be constant over the proximal damper portion 20 and steadily increase in the subsequent distal damper portion 21.

At the head portion 22 and distal end 17 of damper 1 is provided an inner surface 23, which causes a directional deflection for sound in the radial direction toward the central longitudinal axis 1 of damper 1 and in the axial direction toward milling chamber 3. This results in directional deflection of the sound waves in the area of the distal end 17 of damper 1, as schematically shown in FIG. 1 by arrow 24. There is also reflection of sound waves from the inner surface 23. With multiple passes through the interior of the damper 1, a reduction of sound pressure peaks is thus achieved.

The proximal damper section 20 comprises on the inside a cylindrical shell surface 25, which transitions to a conical shell surface 26 in the distal damper portion 21. The distal damper portion 25 is followed by the head portion 22, the distal inner surface 23 of which is curved or angled relative to shell surface 26 of distal damper portion 21 in the radial direction toward the central longitudinal axis Y. In the area of opening 19 of distal end 17 of damper 1, the inner surface 23 can then be curved or bent or angled inward in the proximal direction, also conical. This creates a funnel geometry at distal end 17 of damper 1, which forms a funnel neck 27, which extends relative to the distal end 17 of damper 1 proximally into the interior of damper 1. The distal inner surface 23 in the longitudinal section has approximately the contour of a semicircular torus.

As is apparent from FIG. 2, damper 1 in the area of head portion 22 can have an inside insulation 28 of a sound-absorbing material. Preferably, the insulation 28 is provided at the distal end 17 of damper 1 in the area between funnel neck 27 and the outer wall of damper 1. Thus, the damper 1 also acts as an absorption muffler containing a porous material, such as rock wool, glass wool, glass fibers or foams, which partially absorbs the sound energy, i.e. converts it into heat. The sound absorption effect can be enhanced by the multiple reflection. What is more, a broad frequency spectrum can be covered in the sound attenuation.

It is not shown that damper 1 may also be designed double-walled to reduce sound emissions even more. A sound-absorbing material can be inserted between two walls of damper 1. With a double-walled structure of damper 1, an air layer between two adjacent walls of damper 1 can also already contribute to a reduction of noise emissions.

It will be understood that a corresponding insulation 28 in principle can also be provided in other areas of damper 1. Moreover, the possibility exists of encapsulating an insulating material toward the interior of damper 1 to prevent soiling of the insulating material by the milling material.

It will further be understood that damper 1 can also have an inner contour that differs from the inner contour shown in FIG. 1 and FIG. 2. For example, the lower, proximal damper portion 20 can also have a cross-section expansion in the distal direction. In the proximal damper portion 20, the shell surface 25 can be truncated cone-shaped. A jump in cross-section can also be provided in the transition area between the proximal damper portion 20 and the distally subsequent to distal damper portion 20, created by a step in the wall of damper 1. The change in cross section in the transition area between proximal portion 20 and distal damper portion 21 is then discrete or non-continuous. It is also possible that damper 1 going from proximal end 16 until the transition area of distal damper portion 21 the head portion 22 overall is formed truncated cone-shaped with preferably constant increase of shell surfaces 25, 26.

Furthermore, damper 1 is preferably also designed as multiple parts so that, for example, head portion 22 of damper 1 can be detached from the shell portions 20, 21. This simplifies cleaning of damper 1. But damper 1 can also be designed as one-piece.

In particular, damper 1 may be made of stainless steel or also of plastic, and can be formed as an injection molded part.

FIG. 3 shows damper 1 from FIG. 1 after insertion into milling material hopper 11 of the comminution device 2. In FIG. 4, the damper 1 shown in FIG. 2 is shown in the operating state of comminution device 2. The geometry of damper 1 in the area of the proximal damper portion 20 and the distally subsequent to distal damper portion 21 is adapted to the inner geometry of housing lid 10 in the area of milling material hopper 11. This allows damper 1 to be inserted positively and/or non-positively into milling material hopper 11. Preferably, damper 1 is fully supported against milling material hopper 11. It is not shown that a sealing means can also be provided between damper 1 and milling material hopper 11 to prevent an air passage and thus reduce sound transmission.

Milling material hopper 11 can also be insulated with a sound-absorbing material for passive abatement of noise emissions.

It is understood that the centrifugal mills shown in FIGS. 3 and 4 have been selected only as examples in order to show the advantageous use of damper 1 in the area of the milling material channel. The use of the damper 1 described above can also be provided in comminution devices with a different design structure.

As also emerges from FIGS. 3 and 4, the comminution device 2 shown in its basic structure has a drive 29 from which the drive shaft 4 extends in the distal direction. Rotor 5 is placed on the drive shaft 4 through a sleeve-shaped extension 30. A labyrinth plate 31 is provided to guide rotor 5, on which rotor 5 runs with associated labyrinth designs. A labyrinth seal is formed between labyrinth plate 31 and the labyrinth designs of rotor 5 to seal the milling chamber defined by rotor 5 against the drive shaft 4.

Figure 5:
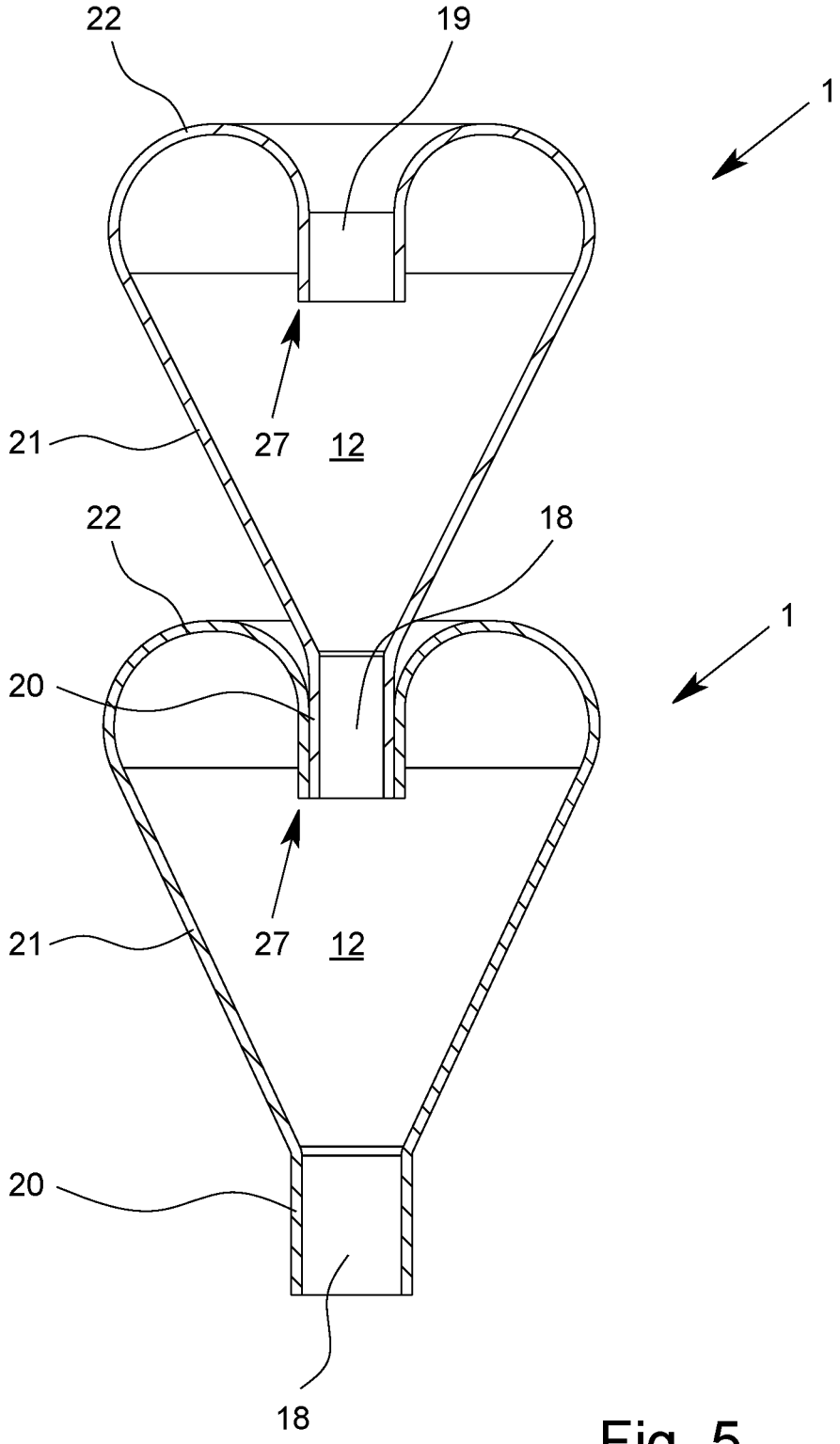
FIG. 5 is two dampers of the type shown in FIG. 1 in a longitudinal section view, where the two dampers are extended into each other.

FIG. 5 shows a cascade arrangement of a plurality of dampers 1, where the damper geometry corresponds to the geometry of the damper 1 shown in FIG. 1. The upper damper 1 shown in FIG. 5 is inserted with its proximal damper portion 20 into the funnel neck 27 of the lower damper 1 shown in FIG. 5. The cascade arrangement of multiple dampers 1 shown leads to a further reduction of noise emissions. In principle, the possibility of the cascade arrangement of multiple dampers 1 is not restricted to the damper geometry shown. Between the proximal damper portion 20 of the upper damper 1 shown in FIG. 5 and the wall section forming the funnel neck 27 of the lower damper 1 shown in FIG. 5, a sealing means and/or an insulation can be additionally provided to prevent an air passage between the dampers 1 in this area and reduce noise emissions even more. Furthermore, the possibility exists to also arrange more than two dampers 1 as a cascade and connected with each other forming a common milling material channel 12.

Figure 6:
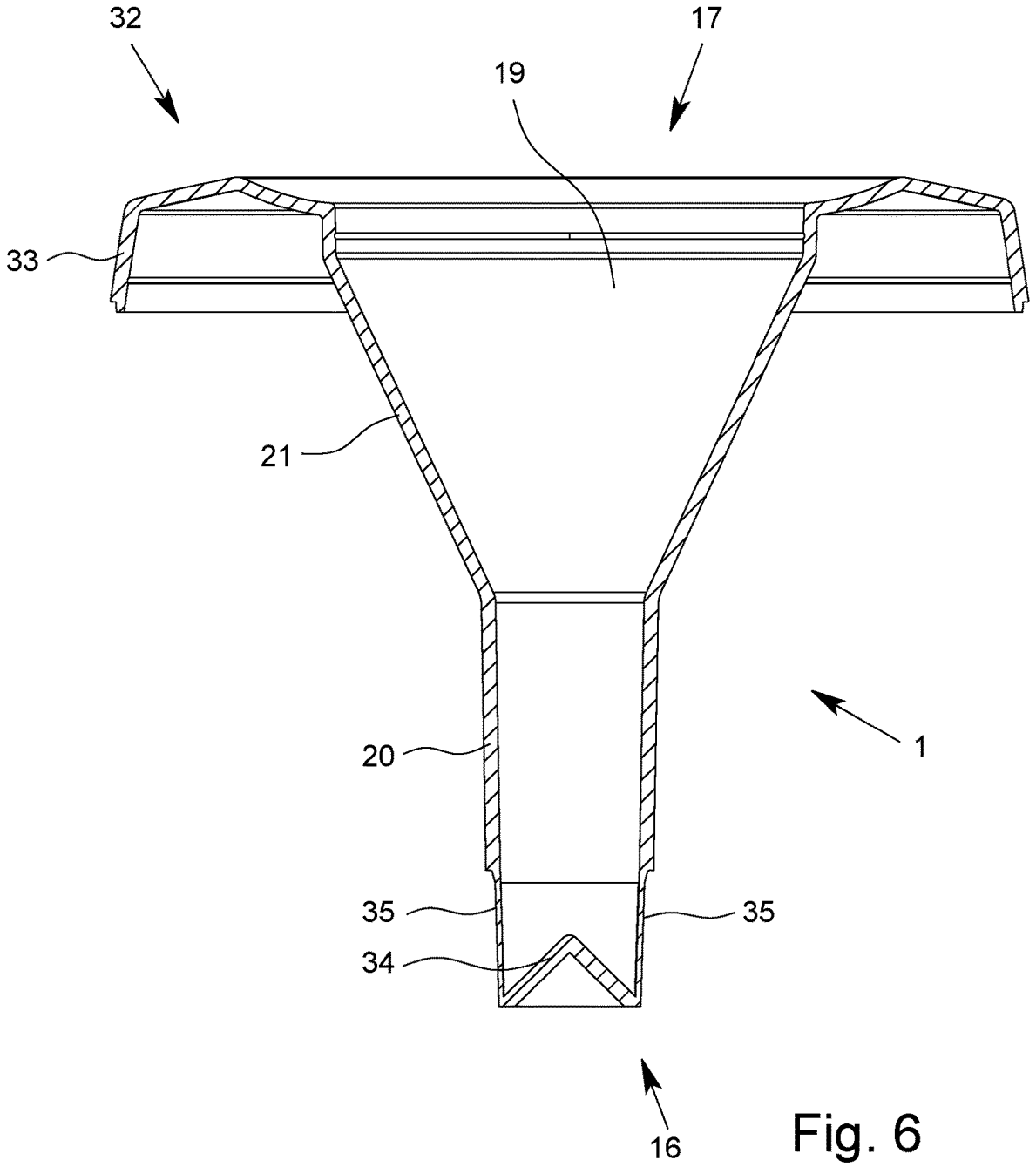
FIG. 6 is a longitudinal section view of another embodiment of a damper designed and provided as a separate device part for use in a comminution device for laboratory operation.
Figure 7:
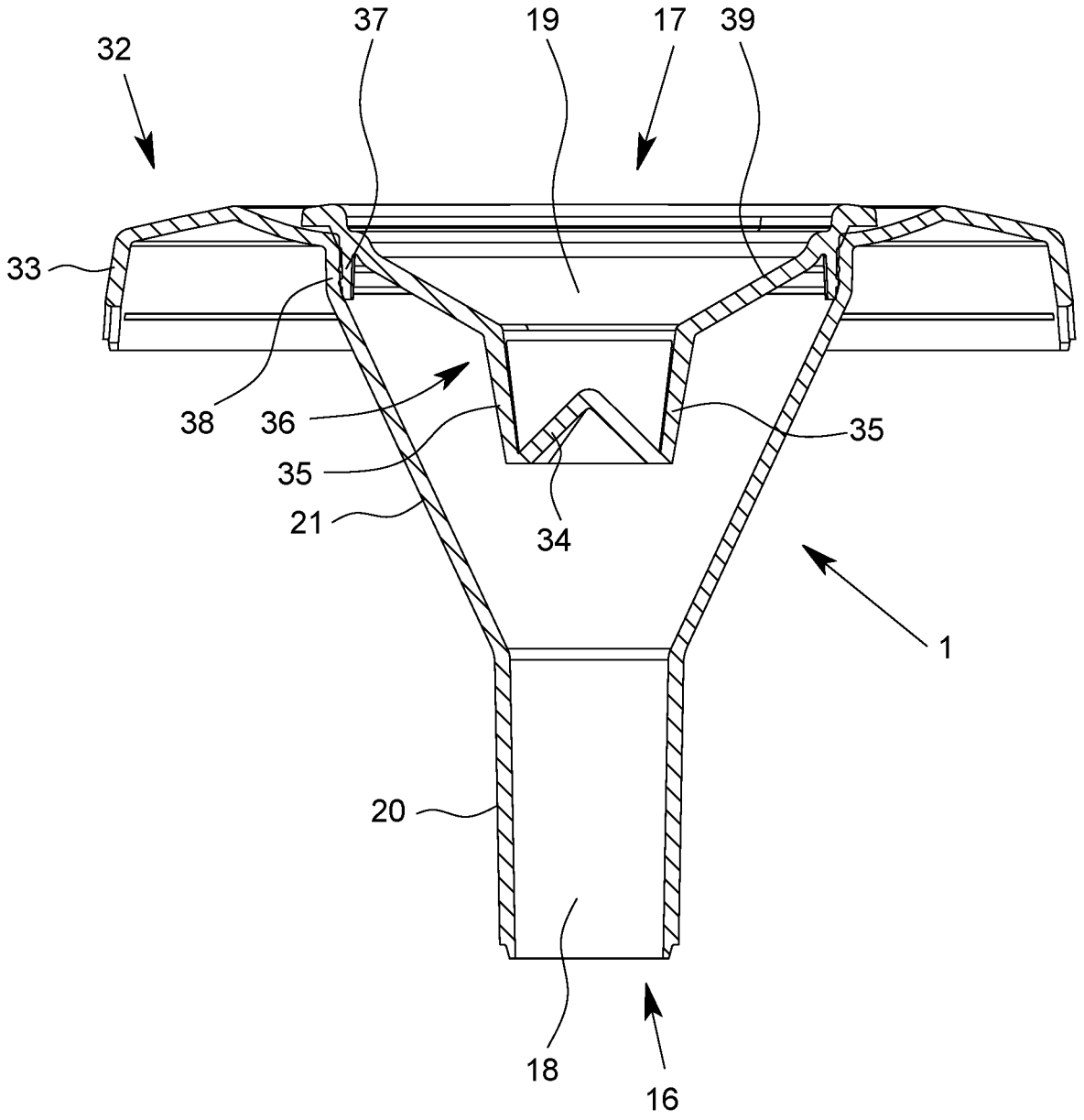
FIG. 7 is a longitudinal section view of a third embodiment of a damper designed and provided as a separate device part for use in a comminution device for laboratory operation, FIG. 8 inserts the damper from FIG. 7 into the milling material channel of a centrifugal mill.
Figure 8:
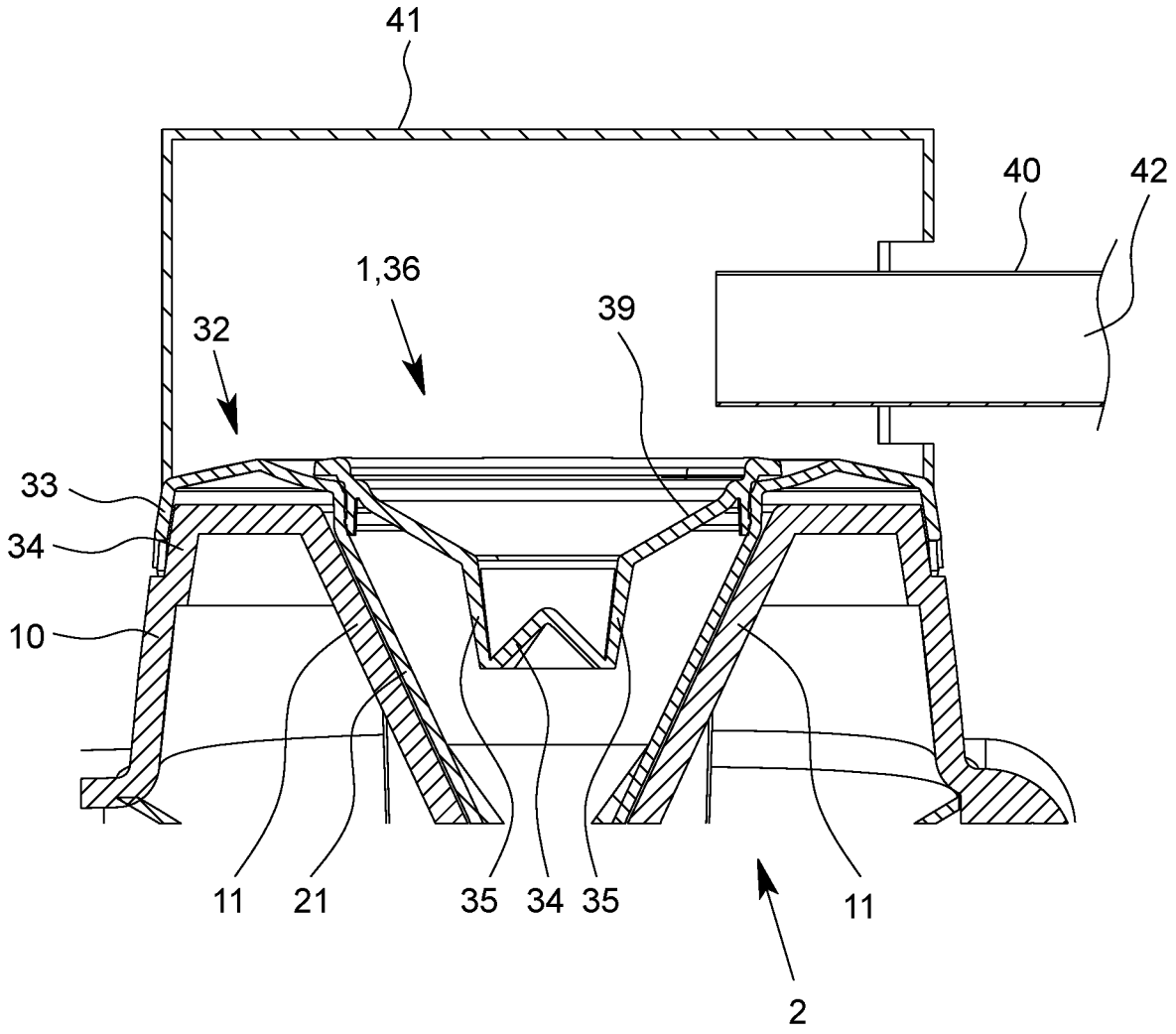

In FIGS. 6 and 7 are shown two more embodiments of dampers 1, which can be inserted for noise abatement into milling material hopper 11 of a comminution device 2. In FIG. 8 is shown the damper 1 shown in FIG. 7 after insertion into the milling material hopper 11. Consistent with this, the two dampers shown in FIGS. 6 and 7 each have a cylindrical proximal damper portion 20 and a distally subsequent, truncated cone-shaped distal damper portion 21. The damper geometry in the area of the damper portions 20, 21 is adapted to the inner geometry of milling material hopper 11, so that damper portions 20, 21 are supported against the wall portions of housing lid 10 forming the milling material hopper 11. This is presented partially in FIG. 8 for the dampers 1 shown in FIG. 7. Between damper portions 20, 21 and housing lid 10, a sealing means and/or an insulation can also be provided in the area of milling material hopper 11.

Also in agreement, the two dampers 1 shown in FIGS. 6 and 7 each have an upper edge portion 32. This is provided to support damper 1 on housing lid 10 if damper 1 is inserted into milling material hopper 11 (FIG. 8). Edge portion 32 with a radial outer edge 33 preferably engages fully an upper stepped wall portion 34 of housing lid 10, so that in milling operation of the comminution device 2, damper 1 is attached to the housing lid 10. In particular, the attachment of damper 1 to housing lid 10 is designed such that relative movements between damper 1 and housing lid 10 cannot occur during operation of comminution device 2 that could lead to emission of interference noise. It is understood that this aspect is independent of the structural design shown in FIG. 8 of the connection between damper 1 and housing lid 10.

The damper 1 may be formed integrally. At the hopper outlet, the damper 1 shown in FIG. 6 has a conical wall portion 34, which is held by wall portions 35 extended web-shaped in the axial direction to the other, proximal damper portion 20 and forms its backsplash guard. The milling material is added through inlet opening 19 into damper 1 and then past the web-shaped wall sections 35 in the direction of milling chamber 3.

A backsplash guard at damper 1 can also be formed by a separate conical body, which can be arranged through corresponding retaining elements or retaining portions of damper 1 above a hopper inlet or at the hopper outlet of damper 1.

The damper 1 shown in FIG. 7 has an insert 36 that forms a backsplash guard. The insert 36 can be held locking in inlet opening 19 of damper 1. For this purpose, insert 36 has a corresponding edge geometry in the area of its outer edge. In the embodiment shown, an axial annular edge portion 37 engages the area of entry opening 19 and has a locking connection from within with an axial wall portion 38 of outer edge 32 of damper 1.

Above the hopper inlet of damper 1, at its proximal end insert 36 has a conical wall portion 34 as backsplash guard, connected integrally through wall portions 35 extended web-shaped in the axial direction with a funnel-shaped inlet portion 39 of insert 36. The milling material is supplied through insert 36 past the web-shaped wall portions 35 into the area between insert 36 and damper 1, and from there through outlet opening 18 to milling chamber 3.

As seen from FIG. 8, an eccentric supply of the milling material to damper 1 can be provided. The milling material can be supplied through a chute 40, guided by a cover 41. The cover 41 covers the damper 1 inserted into milling material hopper 11, and can lie on the outer edge of damper 1 and/or be connected with damper 1. By rotating chute 40, sound emissions can be directed through chute opening 42 to a side of comminution device 2 turned away from the user. The sound then preferably exits only through the chute opening 42. For this purpose, cover 41 can be rotatably connected with damper 1 and/or damper 1 can be rotatably connected with housing lid 10.

Figure 9:
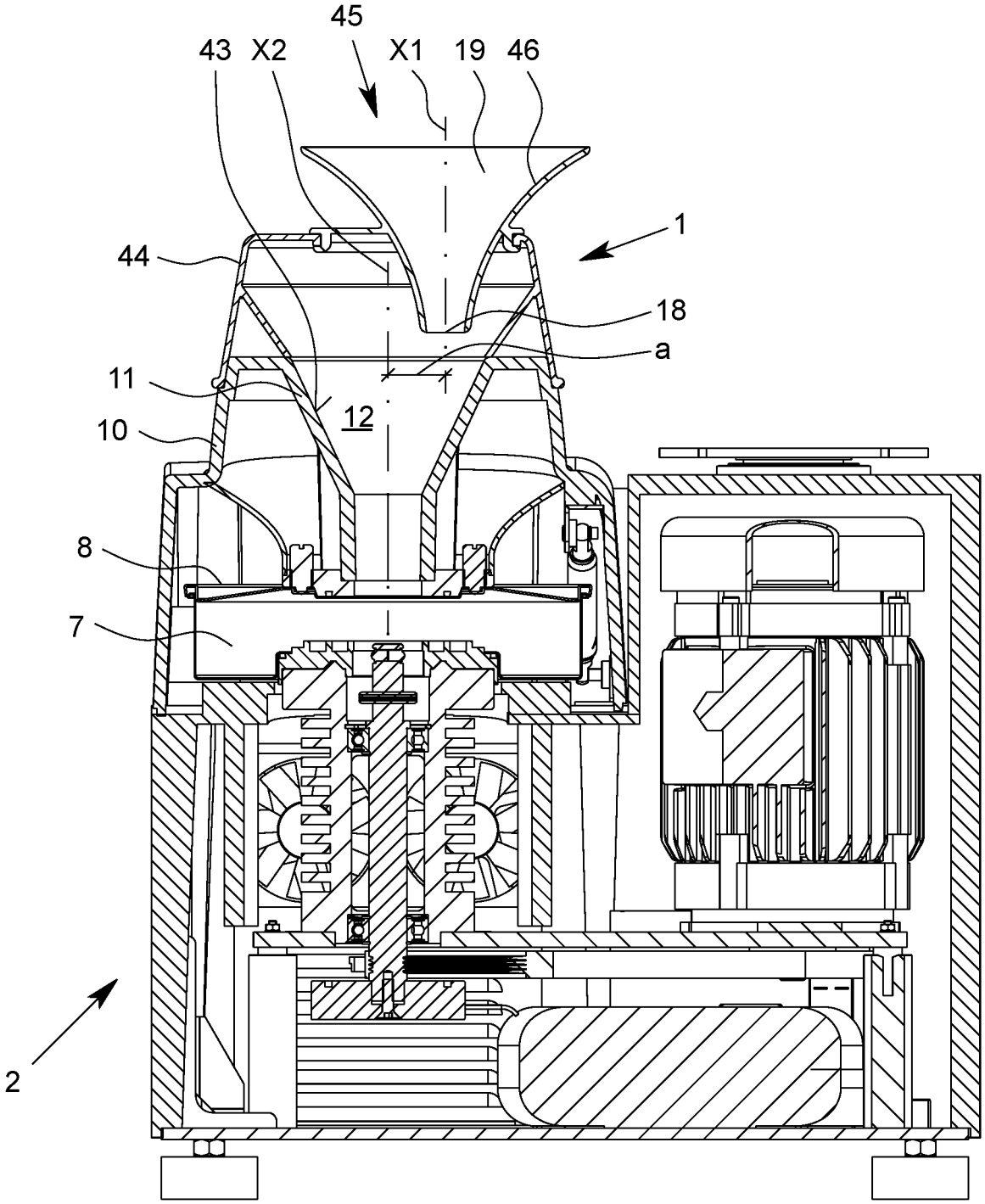
FIG. 9 is a laboratory mill with a damper arranged above a milling material hopper of the laboratory mill in a schematic sectional view.

In FIG. 9, a further embodiment of damper 1 is shown through which an eccentric feed of a milling material to an inclined inlet surface 43 of a milling material hopper 11 of a comminution device 2 is possible. The damper 1 has a damper housing 44, into which a hopper part 45 is inserted. The hopper part 45 has a funnel-shaped wall portion 46, which forms a fill hopper for milling material arranged eccentric to the funnel neck of milling material hopper 11 with a distal inlet opening 19 and a proximal outlet opening 18. The outlet opening 18 is arranged above the inclined inlet surface 45 of milling material hopper 11. This in particular enables an eccentric feed of the milling material into milling material hopper 11, whereby the hopper part 45 supplements milling material hopper 11 upward. The eccentric feed of the milling material through damper 1 results in an even greater reduction of noise emissions in the operation of comminution device 2. The hopper part 45 can also be connected rotatably with damper housing 44, and/or a rotatable connection of damper housing 44 with housing lid 10 can be provided. By rotating hopper part 45, the distance a between the axis of symmetry X1 of hopper part 45 and the axis of symmetry X2 of milling material hopper 11 can be changed as needed.

List of reference numbers:

| | |
|---|---|
| 1 | damper |
| 2 | comminution device |
| 3 | milling chamber |
| 4 | drive shaft |
| 5 | rotor |
| 6 | annular sieve |
| 7 | collection container |
| 8 | container lid |
| 9 | milling material inlet opening |
| 10 | housing lid |
| 11 | milling material hopper |
| 12 | milling material channel |
| 13 | housing |
| 14 | base plate |
| 15 | arrow |
| 16 | proximal end |
| 17 | distal end |
| 18 | outlet opening |
| 19 | inlet opening |
| 20 | proximal damper portion |
| 21 | distal damper portion |
| 22 | head portion |
| 23 | inner surface |
| 24 | arrow |
| 25 | shell surface |
| 26 | shell surface |
| 27 | funnel neck |
| 28 | insulation |
| 29 | drive |
| 30 | extension |
| 31 | labyrinth plate |

-continued

| List of reference numbers: | |
|---|---|
| 32 | edge portion |
| 33 | outer edge |
| 34 | wall portion |
| 35 | wall portion |
| 36 | insert |
| 37 | edge portion |
| 38 | wall portion |
| 39 | inlet portion |
| 40 | chute |
| 41 | cover |
| 42 | chute opening |
| 43 | inlet surface |
| 44 | damper housing |
| 45 | hopper part |
| 46 | wall portion |
| Y | central longitudinal axis |
| X1 | axis of symmetry |
| X2 | axis of symmetry |
| a | spacing |

The invention claimed is:

1. A comminuting device for laboratory operation, comprising;

a milling tool arranged in a milling chamber;

a housing assembly associated with the milling chamber, the housing assembly having a housing wall that forms a milling material hopper;

a milling material channel that extends through the milling material hopper into the milling chamber;

wherein the milling material channel is adapted to supply milling material to the milling chamber or remove milling material from milling chamber when the milling material channel is open to the environment for a successive supply of milling material to the milling chamber during a milling operation;

at least one damper inserted into the milling material hopper and arranged in the area of milling material channel for passive reduction of noise emissions by at least partial reflection of noise from cross-sectional changes in the at least one damper, directional changes in the at least one damper, or a combination thereof; and wherein the at least one damper has a proximal portion having a first opening associated with the milling chamber and a distal portion having a second opening opposite the proximal portion, and wherein a cross-sectional geometry of the proximal portion corresponds with a cross-section geometry of the milling material hopper of the comminution device.

2. The comminution device according to claim 1, wherein the first opening of the at least one damper corresponds with an inlet of the milling chamber, and wherein the distal portion of the at least one damper forms a funnel geometry that defines a material inlet for milling material.

3. The comminution device according to claim 1, wherein the at least one damper is closed on a shell side.

4. The comminution device of claim 1, wherein the first and second opening are arranged coaxially, and wherein the first opening has a larger cross-section than the second opening.

5. The comminution device of claim 1, wherein the at least one damper is configured to accept milling material feed from a direction other than parallel to a central longitudinal axis of the at least one damper.

6. The comminution device of claim 1, wherein the at least one damper in a distal direction has at least a constant or discrete cross-sectional change, the at least one damper cross-section in the distal direction being constant from a proximal end of the damper through the proximal portion and increasing constantly to the distal portion.

7. The comminution device of claim 1, wherein the at least one damper at its distal portion has at least one directional deflection for sound in the radial direction to a central longitudinal axis of the at least one damper or in the proximal direction to the milling chamber.

8. The comminution device of claim 1, wherein at least one sealing means is provided between the at least one damper and the milling material hopper.

9. The comminution device according to claim 1, wherein the at least one damper is integrated into the housing assembly and associated with the milling material channel.

10. The comminution device according to claim 1, wherein the distal portion comprises an inwardly extending neck, such that the second opening is located below an outermost extent of the distal portion.

11. The comminution device according to claim 10, further comprising a toroidal insulation member situated between an outside surface of the inwardly extending neck and an inner surface of the distal portion.

* * * * *